United States Patent [19]

Lindqvist

[11] 4,447,931

[45] May 15, 1984

[54] REMOTELY CONTROLLED VACUUM CLEANER NOZZLE

[75] Inventor: Lennart S. A. Lindqvist, Sundbyberg, Sweden

[73] Assignee: Aktiebolaget Electrolux, Stockholm, Sweden

[21] Appl. No.: 447,165

[22] Filed: Dec. 6, 1982

Related U.S. Application Data

[63] Continuation-in-part of Ser. No. 212,350, Dec. 3, 1980, abandoned.

[51] Int. Cl.[3] ..... A47L 9/06

[52] U.S. Cl. ..... 15/365; 15/357; 15/373; 15/419

[58] Field of Search ..... 15/357, 365, 371, 373, 15/419

[56] References Cited

U.S. PATENT DOCUMENTS

| | | | |
|---|---|---|---|
| 2,312,905 | 3/1943 | Holm-Hansen | 15/357 X |
| 2,658,229 | 11/1953 | Smellie | 15/373 |
| 2,688,763 | 9/1954 | Pfaffle | 15/371 |
| 3,720,977 | 3/1973 | Brycki | 15/321 |
| 3,768,114 | 10/1973 | Schwartz | 15/365 X |

*Primary Examiner*—Chris K. Moore

*Attorney, Agent, or Firm*—Alfred E. Miller

[57] ABSTRACT

A nozzle for a vacuum cleaner which is provided with a suction conduit for attachment to the vacuum cleaner housing. The nozzle has two working members alternately in contact with the work surface. Either of these working members can be alternately placed into operative position by means of a servo mechanism in the form of an actuating member that is movable between two positions.

7 Claims, 4 Drawing Figures

REMOTELY CONTROLLED VACUUM CLEANER NOZZLE

The present invention is a continuation-in-part application of pending application Ser. No. 212,350 filed on Dec. 3, 1980, and now abandoned.

The present invention relates to a nozzle for a vacuum cleaner which is provided with a suction conduit for attachment to the vacuum cleaner housing. The nozzle has two movable working members, such as a brush nozzle and a flat surface nozzle, either of which can be alternately brought into contact with the working surface by means of an actuating member which is movable between two positions.

A vacuum cleaning implement having a fixed and movable nozzle to and from a working position by means of a device actuated by a foot pedal is known. Thus, force applied to the foot pedal results in the removal of a blocking member so that the movable working members of the nozzle can become operative.

Another form of a vacuum cleaner element that is known is one that has a fixed and movable nozzle that are connected to each other by means of springs adjusted to two stable positions. The fixed nozzles are furthermore connected to both longitudinal side portions of the vacuum cleaning implement, while the movable nozzle is connected with the central portion of the cleaning implement provided with an attachment pipe to a vacuum cleaner. In this construction, the movable nozzle is directed to a working position by depressing the central portion, however it is returned from the working position by depressing one of the side portions of the implement.

Another type of known vacuum cleaning implement of the type hereinbefore described requires a force that is applied on the casing of the implement, whereupon one of the nozzles is to be directed into working positions, and a force is applied on a pedal arranged in the casing when the other nozzle is to be brought into working position. The above-described known devices have a common disadvantage in that two different actuating steps are necessitated to bring one or the other nozzle into working position. Furthermore, a rather large force is necessary for the switching operation.

It is an object of the present invention to simplify the handling of a vacuum cleaning device having two movable nozzles relative to each other. Consequently, a suction nozzle is utilized in the present invention having only one actuating member which can be arranged, for example on an operating shaft of the suction conduit, and the switching of the working members can be done manually without interfering with the actuating members on the nozzle itself.

In order that the invention will be more clearly understood, it will now be disclosed in greater detail with reference to the accompanying drawings, in which.

Figure 1:
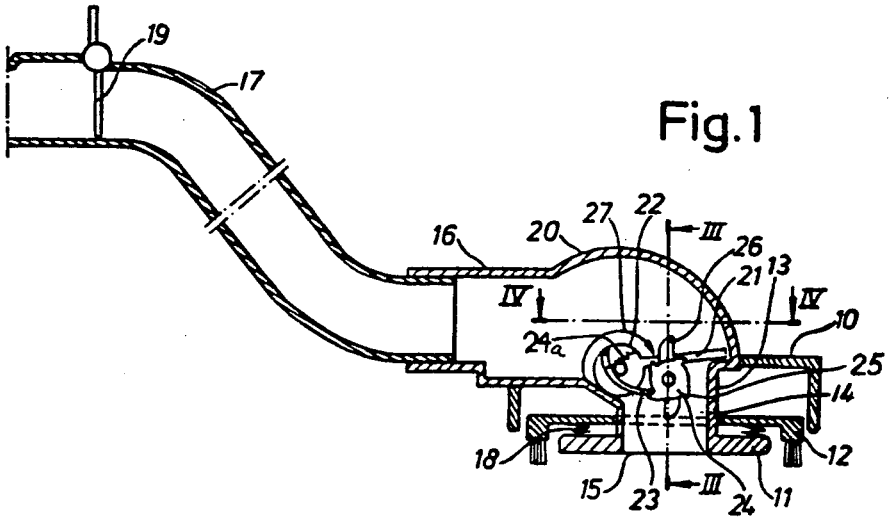
FIG. 1 is a side elevational view, partly in section, showing the brush nozzle in its outward position on the working surface.
Figure 4:
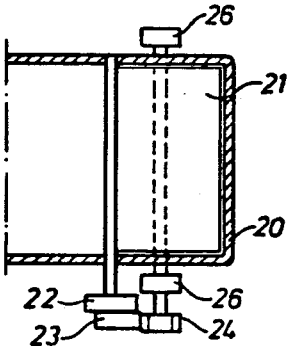
FIG 4 is a horizontal sectional view taken along the lines IV—IV of FIG. 1.

The suction nozzle, as shown in the drawings, comprises a housing 10, a flat surface nozzle 11 and a brush nozzle 12. In the central portion of the flat surface nozzle substantially vertical walls are arranged with their upper edges abutting against the housing. Thus, the walls 13 from a suction channel 14 conduct air from the suction opening 15 of the nozzle to its attachment pipe 16 connecting the nozzle through a suction conduit with a vacuum cleaner (not shown). The suction nozzle additionally is provided with a brush nozzle 12 that is movable against the force of a spring 18 between a lower position, which is its working position, to its upper, idle position.

A suction conduit 17, by means of its attached wand (not shown), functions to move the suction nozzle on the working surface. A valve 19 is arranged in the suction conduit 17 by the aid of which the through flow area of the suction conduit is closable, as shown in FIG. 1. Between the nozzle housing and the attachment pipe 16 a casing 20 is arranged in which a flap 21 is swingably mounted by means of a cylindrical hub 22. To the periphery of the hub an arc-shaped pawl or a stepping hook 23 is connected by one of its ends, and is freely pivotable therein. Its other free end lies against a stepping wheel 24, having on its periphery four outwardly directed projections 25, and is held in engagement therewith by means of a spring 24*a*. It should be evident that particular shape of hook 23 ensures that the free end thereof remains in engagement with one of the teeth 25 of the wheel 24 upon rotation thereof. In addition, two diametrically opposed cam surfaces 26 are fixed on the stepping wheel 24. A spring 27 holds the flap 21 in the position shown in FIG. 1, in which position the flap closes the suction channel 14.

Figure 2:
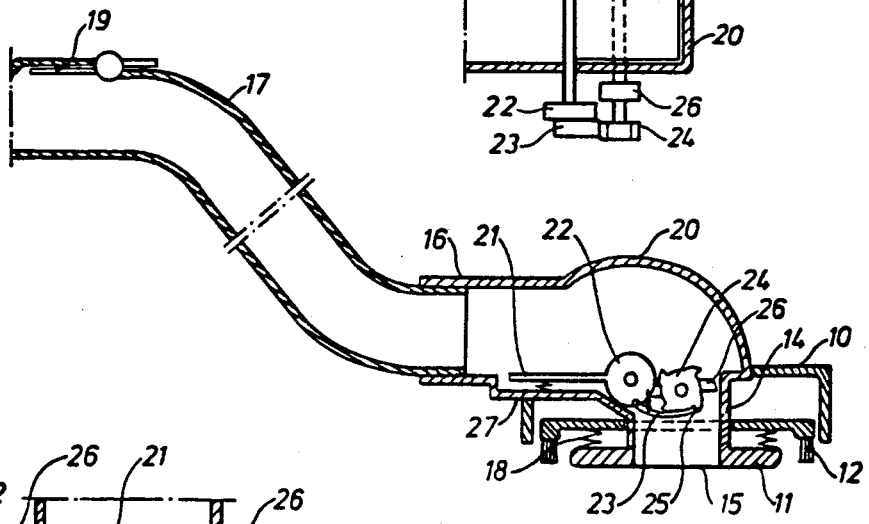
FIG. 2 is also a sectional view, partly in elevation, in which the flat surface nozzle is in contact with the surface to be cleaned.
Figure 3:
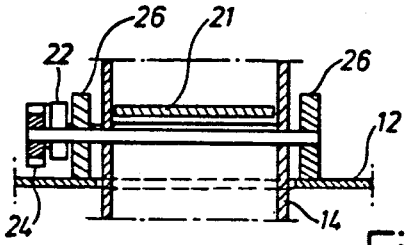
FIG. 3 is a vertical sectional view taken along the lines III—III of FIG. 1.

The operation of the device is as follows: When no air is flowing through the suction nozzle the valve 19 and the flap 21 are in the position shown in FIG. 1. The flap is actuated by the spring 27 to the closed position. When the valve 19 is moved to the position shown in FIG. 2, the flap 21 is pivoted against spring force, due to the negative pressure created in the suction conduit, to the position shown in FIG. 2. The stepping hook 23 is pushed against one of the projections 25 of the stepping wheel 24 and the stepping wheel 24 with its cam surfaces is thereby turned counter-clockwise 90°. Consequently, the cam surfaces 26 take the position shown in FIG. 2 and the spring 18 lifts the brush nozzle to its idle position. Thus, one working cycle consists of a closing and opening of the valve 19. When the motor fan unit of the vacuum cleaner is stopped the flap 21 returns to the position shown in FIG. 1, and carries with it the stepping hook 23, which engages the next adjacent projection.

The valve 19 is preferably arranged within the operating shaft of the suction conduit, and is actuated manually against the force of a spring (not shown) so that it closes the through flow area of the suction conduit in its end position. The nozzle, itself, can be provided with means for visual indication of the position of the working members 11 and 12 in relation to the working surface.

One advantage of the arrangement according to this invention is the circumstance that the shifting of the working members of the nozzle can be done by hand from the operating shaft without cumbersome transmission devices such as wires, hoses, etc. Furthermore, the device has a servo effect, i.e. the actuating force required is considerably smaller than in a directly actuated shifting mechanism.

What is claimed is:

1. In a suction nozzle attached to a suction conduit of a vacuum cleaner and provided with a brush nozzle and a flat surface nozzle, both of which are working members, and can be alternately brought into engagement with the work surface by means of an actuating member, the improvement comprising: said actuating member being a valve mounted on said suction conduit remote from said nozzle which is movable between two end positions to change the pressure conditions in said conduit to either open or close said suction conduit, and a movable blocking element adapted to be mounted in said nozzle to normally close the suction channel of said nozzle, and during the opening of said suction channel by said valve to move to a position whereby said suction channel is opened, and means responsive to movement of said element to its open position to cause one of said working members to move away from said work surface while the other of said working members moves into contact with said work surface due to the substantially unrestricted negative pressure generated in said suction conduit.

2. A suction nozzle as claimed in claim 1 wherein said element changes the pressure conditions in said suction conduit in order to achieve said change of position of one of said working members relative to said work surface.

3. A suction nozzle as claimed in claim 2 wherein said element is a flap, means pivotally mounting said flap between two end positions adjacent to said suction channel, and further including a spring biasing said flap to a first end position, and after said valve is opened due to negative pressure generated in said suction channel, said flap is moved to its second end position.

4. A suction nozzle as claimed in claim 3 wherein said means includes a hub for said flap, a pivotally mounted stepping wheel, and a stepping hook, said hook being mounted to said hub to actuate the pivotally mounted stepping wheel during the movement of said flap.

5. A suction nozzle as claimed in claim 4 wherein said stepping wheel is provided with two cam surfaces on its outer periphery by means of which said brush nozzle is moved into contact with the work surface.

6. A suction nozzle as claimed in claim 1 wherein said valve is manually actuatable whereby it closes in one of its end positions the through flow area of said suction conduit.

7. A suction nozzle as claimed in claim 1 wherein said nozzle provides a visual indication of the respective positions of the working members relative to the work surface.

* * * * *